US008668555B2

(12) United States Patent
Scherl

(10) Patent No.: US 8,668,555 B2
(45) Date of Patent: Mar. 11, 2014

(54) GRINDING MACHINE AND TOOL-SUPPORT APPARATUS THEREFOR

(75) Inventor: Thomas Scherl, Ichenhausen (DE)

(73) Assignee: Scheppach Fabrikation von Holzbearbeitungs-Maschinen GmbH, Ichenhausen (DE)

( * ) Notice: Subject to any disclaimer, the term of this patent is extended or adjusted under 35 U.S.C. 154(b) by 429 days.

(21) Appl. No.: 13/033,794

(22) Filed: Feb. 24, 2011

(65) Prior Publication Data

US 2011/0212671 A1 Sep. 1, 2011

(30) Foreign Application Priority Data

Feb. 26, 2010 (DE) ..... 20 2010 002 886 U
Jul. 12, 2010 (DE) ..... 20 2010 010 179 U

(51) Int. Cl.
*B24B 7/00* (2006.01)

(52) U.S. Cl.
USPC ..... 451/159; 451/340; 451/212; 451/213; 451/224; 451/403

(58) Field of Classification Search
USPC ..... 451/159, 340, 212, 213, 224, 229, 241, 451/45, 403, 404, 405
See application file for complete search history.

(56) References Cited

U.S. PATENT DOCUMENTS

| | | | | |
|---|---|---|---|---|
| 642,180 | A * | 1/1900 | Twist | 451/231 |
| 3,298,413 | A * | 1/1967 | Walter | 83/174 |
| 5,218,787 | A * | 6/1993 | Rice | 451/229 |
| 5,437,570 | A * | 8/1995 | Landhuis | 451/296 |
| 6,623,340 | B2 * | 9/2003 | Jansson | 451/241 |
| 7,413,504 | B2 * | 8/2008 | Lytinas | 451/67 |
| 2005/0090184 | A1 | 4/2005 | Zhang | |
| 2005/0287934 | A1 * | 12/2005 | Jansson | 451/45 |
| 2006/0154576 | A1 * | 7/2006 | Hepworth | 451/45 |

FOREIGN PATENT DOCUMENTS

WO 2007098470 A2 8/2007

* cited by examiner

*Primary Examiner* — George Nguyen
(74) *Attorney, Agent, or Firm* — Bacon & Thomas, PLLC

(57) ABSTRACT

A tool-support apparatus for attachment to a grinding machine, in particular to a wet grinding machine, which has at least one grinding disc arranged on a rotatably drivable grinding-disc shaft and a machine frame or housing in which the grinding-disc shaft is supported. The tool-support apparatus has a tool-support, which can be secured on a machine frame or housing of the grinding machine, for the support during the grinding process of a tool that is to be ground, and an arresting apparatus for securing the tool support on the machine frame or housing. The tool-support can be secured on the machine frame or housing in such a way that it can be swivelled about the grinding-disc shaft or about a swivel axis parallel to the grinding-disc shaft and can be arrested by way of the arresting apparatus in a plurality of angular positions.

15 Claims, 10 Drawing Sheets

GRINDING MACHINE AND TOOL-SUPPORT APPARATUS THEREFOR

TECHNICAL FIELD

The invention relates to a grinding machine and to a tool-support apparatus that is suitable therefor.

BACKGROUND DISCUSSION

Grinding machines of the generic type have a grinding disc that is supported on a rotatably drivable grinding-disc shaft in a machine housing or frame, wherein for the support during the grinding process of a tool that is to be ground there is provided a tool-support that is secured to the machine frame and has a support section overlapping the grinding disc on the circumferential side. Such tool-supports are used in particular in wet grinding machines.

Such a wet grinding machine is distributed by the firm of Scheppach Fabrikation von Holzbearbeitungsmaschinen GmbH under the name of Tiger 2500 and is shown on pages 65 to 67 of the prospectus "Scheppach Werkstatt" 2010-02 DE. The tool-support here has a transverse spar that overlaps the grinding disc on the circumferential side and is secured by way of two longitudinal spars in sleeves fitted on the housing side. The longitudinal spars can in this case be fixed in height by way of fastening screws, which can be screwed by way of star wheel into the securing sleeves and can be fastened, depending on the type of tool to be set on and ground, at the desired height or with the desired spacing of the transverse spar from the circumferential surface of the grinding disc. Depending on the tool that is to be ground, however, it is also necessary for the tool-support apparatus to have a location in which the transverse spar is not fitted above the grinding disc, but at the side next to the disc. For this, two further securing sleeves for the longitudinal spars are secured on the cover wall of the machine housing, formed, however, to fix the longitudinal spars in the horizontal direction instead of in the vertical direction.

SUMMARY OF THE INVENTION

From this starting-point, the present invention aims to provide a grinding machine and a tool-support apparatus therefor with which the operation of the grinding machine is simplified and is made usable for extended scenarios of application.

This object is achieved with regard to the tool-support apparatus by means of the features of claim 1 and with regard to the grinding machine by means of the features of claim 14.

In accordance with the invention, the tool-support apparatus in this connection has a tool-support that can be secured on a machine housing or machine frame of the grinding machine in such a way that it can be swivelled about the grinding-disc shaft or about a swivel axis that is parallel to the grinding-disc shaft, and also an arresting apparatus for arresting the tool-support in a plurality of angular positions, i.e. in one angular position that can be selected from the plurality of angular positions.

In the case of this tool-support or grinding machine, re-assembly of the tool-support, as was necessary in the case of previous grinding machines of the generic type, need not take place when there is to be a change-over from a tool that is to be ground in one position to a tool that is to be ground in the other position.

Advantageously, the tool-support apparatus has a swivel piece that can be received on the machine housing or machine frame in such a way that it can be swivelled and by way of which the tool-support can be secured on the machine housing. In this connection, the swivel piece can have an outer circumferential contact section extending coaxially or parallel to the swivel axis in the state of securement on the machine housing, wherein the arresting apparatus then has at least one clamping jaw, movable in and out of contact with the outer circumferential contact section and having an inner circumferential contact section, and also a clamping-jaw-actuating device in order to move the movable clamping jaw in and out of contact with the outer circumferential contact section so that the swivel piece can be arrested in its angular location with respect to the machine housing and can be released for swivelling.

As a result of fixing or arresting the tool-support, which by way of the swivel piece is received on the machine housing in such a way that it can be swivelled, in the desired angular position by way of the clamping jaws or jaw acting on the outer circumferential contact section of the swivel piece that can be swivelled with respect to the machine housing, a particularly simple and inexpensive structure of the arresting apparatus and thus of the tool-support apparatus as a whole is successfully achieved.

On account of the swivelling securement of the swivel piece, in this connection the tool-support can be arrested in a plurality of angular positions so that new sharpening positions and possibilities are opened up that are advantageous in particular in connection with a grinding disc that is rotatably drivable in two directions of rotation, because then any desired grinding process can be carried out from one side of the grinding machine and the grinding machine can always remain directed towards the operator side, whilst in the case of earlier solutions the grinding machine had to be turned round.

If the outer contact circumferential contact section on the swivel piece is formed in this connection in a cylindrical or at least cylinder-segment-shaped manner and the at least one movable clamping jaw likewise has a cylinder-segment-shaped, preferably semi-cylindrical inner circumferential contact section, the angular location of the swivel piece and thus of the tool-support can be continuously adjusted with respect to the machine housing. Moreover, on account of a large contact surface firm clamping of the swivel piece in the arrested position is successfully achieved. The firmness of clamping could, for example, be intensified further by applying to the inner circumferential contact section and/or outer circumferential contact section a layer of material that has a high coefficient of friction, for example an insert of rubber or a roughened metal surface.

It is favourable in this connection if the support section of the tool-support apparatus, as in the case of known tool-support apparatuses, is formed as a transverse spar, and the spacer section has two longitudinal spars secured on the transverse spar and spaced apart from each other. The longitudinal spars can then be held in swivel sleeves which in turn, being in one piece with a cross-connecting hub or fixedly connected with the cross-connecting hub, form the swivel piece. The outer circumferential contact section for the movable clamping jaw can then be formed on the cross-connecting hub that connects the two swivel sleeves that are spaced apart from each other.

The clamping jaw or jaws can then be located between the two swivel sleeves in the direction of the swivel axis. It would, however, also be possible to lengthen the cross-connecting hub beyond one of the swivel sleeves and provide the outer circumferential contact section, serving as an engagement section for the clamping jaw or jaws, next to the two swivel sleeves.

The clamping-jaw-actuating device can have an arresting rod that is connected to the movable clamping jaw and extends, for example, in a perpendicular direction with respect to the direction of the swivel axis and on which a handle is secured in order to move the movable clamping jaw in the direction that is perpendicular to the direction of the swivel axis in and out of contact with the outer circumferential contact section.

Advantageously, in this connection a guiding device for the movable clamping jaw is provided by way of which the movable clamping jaw, displaceably guided in a direction of displacement that is inclined with respect to the axial direction of the swivel axis, preferably extending perpendicularly, and preferably horizontal, can be fitted on the machine housing so that the movable clamping jaw can be displaced in the radial direction of the swivel axis or with a radial-direction component towards and away from the outer circumferential contact section.

The guiding device for this purpose can have, for example, at least two guide pins that can be fitted on the machine housing in parallel and at a distance from each other extending in the direction of displacement and on which the movable clamping jaw is received in a displaceable manner. The guide pins can then, for example, be secured on a securing bracket that can be screwed together with or otherwise secured on the machine housing, wherein the guide pins can extend between a first securing block of the securing bracket and a further securing block which with respect to the first securing block is arranged on the side of the outer circumferential contact section that lies opposite the movable clamping jaw.

The further securing block can be formed as a second clamping jaw that is fixed with respect to the housing and can have a preferably substantially semi-cylindrical inner circumferential contact section with which it can press against the outer circumferential contact section. It would also be possible, however, to receive the clamping jaw on a slide for which one or more preferably horizontally extending guide rails or grooves are formed on the machine housing.

Advantageously, the arresting rod can then have a thread, in particular a trapezoidal thread, with which it is screwed in the further securing block, which can be fitted in a fixed manner with respect to the housing and is preferably formed in one piece with the securing bracket, with a screw axis extending in the direction of displacement of the clamping jaw, wherein the arresting rod is connected to the movable clamping jaw in a rotatable, yet pressure- and tensile-force-transmitting manner. The movable clamping jaw can thus be engaged with and disengaged from the outer circumferential contact section of the cross-connecting hub in a simple manner, wherein automatic arrest is effected by means of the trapezoidal thread. It would, however, likewise be possible to screw the arresting rod into a threaded bore in a housing wall of the machine housing.

Securement of the swivel piece on the machine housing or machine frame, which from the point of view of construction is particularly inexpensive and can easily be swivelled, results if the swivel piece has on both sides a respective receiving bore, which is coaxial with respect to the swivel axis that is provided, for a respective swivel pin in order to suspend the swivel piece in such a way that it can be swivelled between two housing walls of the machine housing so that the swivel pins serve as or define the swivel axis.

In the case of this further development it would likewise be possible to lengthen the cross-connecting hub so far beyond at least one of the swivel sleeves that the cross-connecting hub that is in one piece with or is fixedly connected to the swivel piece serves as at least one of the swivel pins. In this connection, it would then be possible, furthermore, for the outer circumferential contact section serving as the engagement section for the clamping jaw or jaws to be located on that side of one of the housing walls, in which the swivel piece is mounted, that lies opposite the swivel piece.

For this, there can be provided on the upper side on the machine housing two parallel housing walls between which the swivel piece is received and which have receivers on the housing side that are suitable for the swivel pins. Advantageously, these receivers on the housing side can be formed as through-threaded bores that are screwed into the respective housing wall and into which the swivel pins are screwed from the wall side that is remote from the swivel piece and plugged into the swivel-pin-receiving bores on the swivel-piece side.

The swivel piece can then have, furthermore, on its sides facing the housing walls a plurality of locating receivers that are arranged in the shape of a circular segment concentrically with respect to the swivel axis, wherein then there can be provided on the associated housing wall at the radial height of the plurality of locating receivers a locating head which protrudes in the direction of the swivel piece and forms together with the locating receivers an angle grid which defines a number of preferred angular positions, for instance all angles in 15°-intervals between the horizontal alignment of the swivel piece and the vertical alignment of the swivel piece.

A further advantageous further development relates to the vertical adjustability of the tool-support apparatus. Advantageously, the two longitudinal spars are received in this connection in a vertically adjustable manner in the associated swivel sleeves. For the purposes of fastening the longitudinal spars in the swivel sleeves, the swivel sleeves can each have in the proximity of their upper free end an outer circumferential threaded section on which there is screwed a clamping bushing provided with an inner circumferential thread. On the clamping bushings there can be provided in each case a clamping-ring section with a wedge section which tapers in its course from top to bottom inwards and with which a counter-wedge section tapering in its course from bottom to top outwards is associated at the upper free end of the respective swivel sleeve so that the clamping bushings can be brought out of height-adjustable setting into a vertically held setting by screwing far enough onto the respectively associated swivel sleeve.

If in this connection at least one of the longitudinal spars is provided with a scale indicating the height of extraction of the tool-support, simple setting of the height of extraction of the support section of the tool-support is successfully achieved. If the scale, furthermore, being displaceable along the longitudinal spar is secured at a stop which is likewise displaceable along the longitudinal spar, for example at a stop disc that is positioned about the longitudinal spar and can be fixed at a desired height, even with different stone diameters as a result of the adjustable height scale exactly the same vertical spacing from the grinding stone can always be set in a successful way. In this connection, the necessary grinding angle of the tools can be set comparatively quickly without long and expensive angle gauges that are used in the case of all conventional grinding machines. As a result of the adjustability and fixability of the stop disc and the height scale, it is possible to carry out "zeroing" of the tool-support with respect to the grinding-disc diameter and thus a very rapid and simple setting.

The arresting apparatus thus advantageously comprises a number of clamping jaws acting on the outer circumference of the cross-connecting hub or another component extending coaxially with respect to the swivel axis, and also an actuating device therefor, for example the movable clamping jaw, the arresting rod therefor with the handle, and the opposing fixed clamping jaw.

The arresting apparatus can, however, also have two jaw pieces that are received in a rotatably secure manner and so that they are displaceable along the swivel axis and which with a respective face pointing in the axial direction with a tooth construction face a counter-face facing this face on the spacer section with a counter-tooth construction. The counter-face can then be formed on the respective side faces facing each other of the two swivel sleeves which in this case are arranged separately and so that they are spaced apart from each other. Furthermore, a displacing and fastening device can then be provided in order to displace the two jaw pieces out of an arrested position with a face acting on the associated counter-face into a swivel position without a face acting on the associated counter-face, and back, and in order to fasten the number of jaw pieces in the desired position.

BRIEF DESCRIPTION OF THE DRAWINGS

Further advantages and features of the invention shall be explained in greater detail with reference to the embodiment of the invention that is shown in the attached drawings, in which.

DETAILED DISCUSSION IN CONJUNCTION WITH THE DRAWINGS

Figure 1:
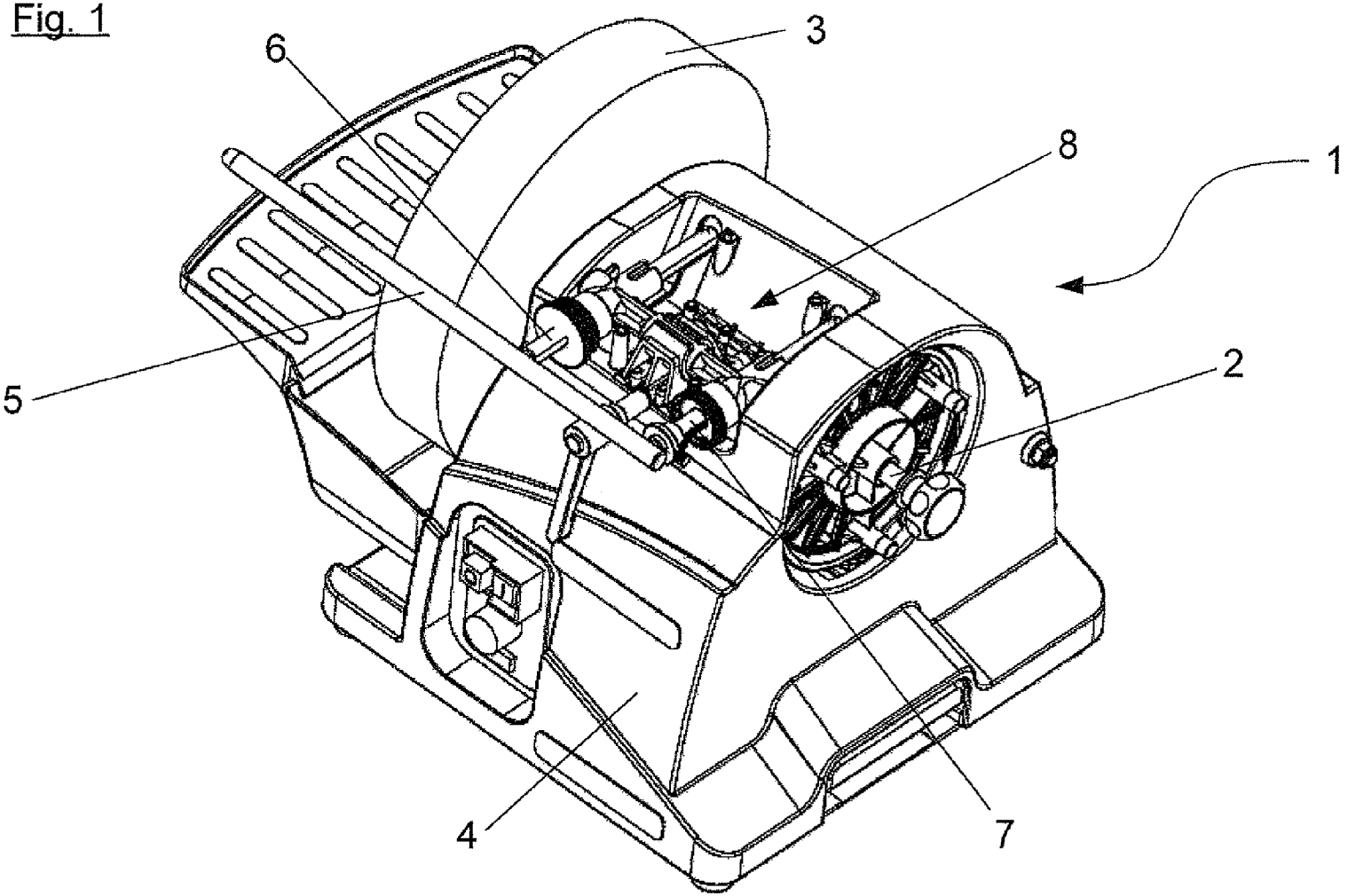
FIG. 1 shows a perspective view of a wet grinding machine according to one embodiment of the invention.
Figure 2:
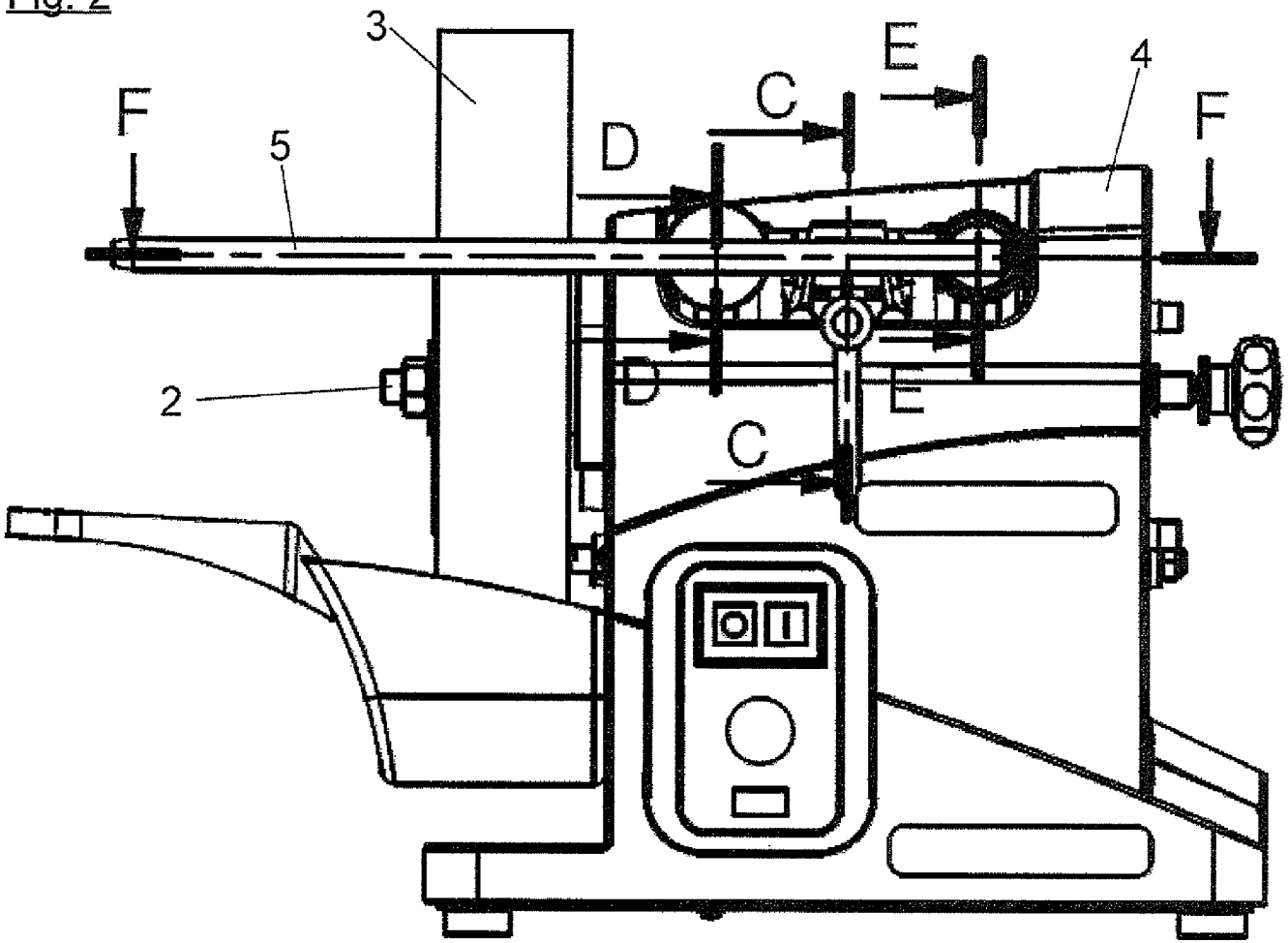
FIG. 2 shows a side view of the wet grinding machine that is shown in FIG. 1.

Reference is made in the first instance to FIGS. 1 and 2 which show a wet grinding machine denoted as a whole by 1. The wet grinding machine has a grinding-disc shaft 2 on which a grinding disc 3 is received in a rotatably drivable manner.

The machine housing 4 has in this connection on the upper side a trough or receiver in which a tool-support apparatus in secured on the grinding machine 1. The tool-support apparatus has in this connection a tool-support 5, 6, 7 and an arresting apparatus denoted as a whole by 8. The tool-support 5, 6, 7 has a transverse spar 5 which projects over the circumference of the grinding disc 3 and which in turn is secured on the grinding machine 1 or on the machine housing 4 so that it can be swivelled and arrested in various angular positions by way of two longitudinal spars 6, 7, secured to it, and the arresting apparatus denoted as a whole by 8.

Furthermore, the longitudinal spars 6, 7 can be extended and retracted so that the transverse spar 5 is also adjustable in terms of its height with respect to the grinding disc 3. All in all, a grinding machine thus results that has many possible grinding positions, since the location of the transverse spar 5 with respect to the grinding disc 3 can be configured almost freely.

Figure 3:
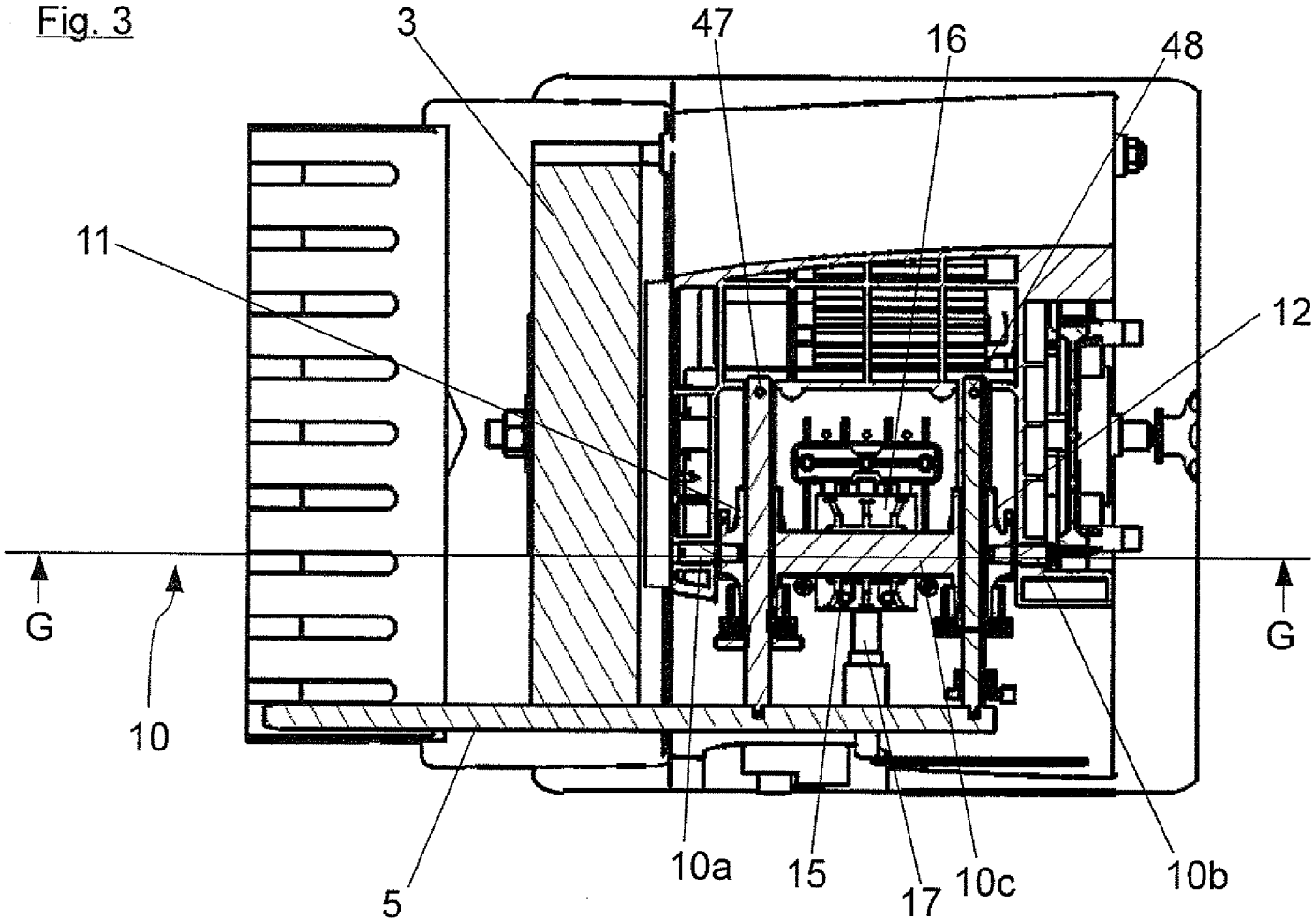
FIG. 3 shows a section along the line F-F in FIG. 2.
Figure 6:
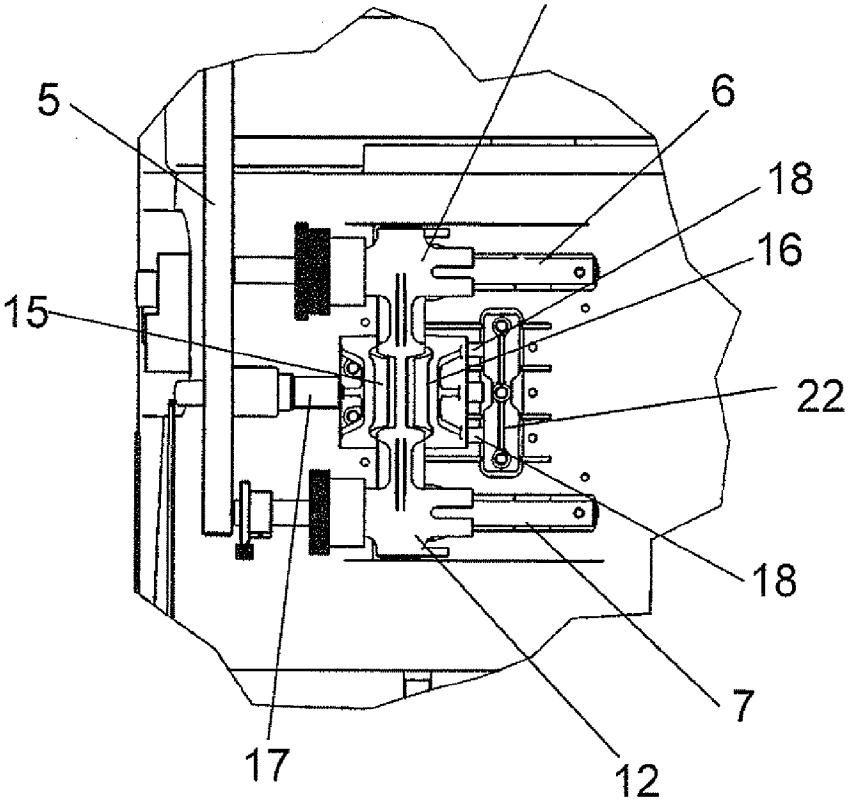
FIG. 6 shows a detailed view from above of the tool-support apparatus according to FIGS. 4 and 5 attached to the grinding machine shown in the preceding FIGS. 1 to 3.

In this connection, it can be inferred from FIGS. 3 and 6 how the tool-support 5, 6, 7 is secured on the machine housing 4. For this, the tool-support apparatus has a swivel piece 11, 12, 10*c* with two swivel sleeves 11, 12 which are connected by way of a cross-connecting hub 10*c* and are spaced apart from each other and in which the longitudinal spars 6, 7 are inserted in a vertically adjustable manner. The vertical adjustment is arrested in this connection in a manner that is explained further in greater detail below. Provided at the lower end of the longitudinal spars 6, 7 there are in this connection respective securing pins 47, 48 which prevent the tool-support 5, 6, 7 from being able to be extracted out of the swivel sleeves 11, 12.

Figure 4:
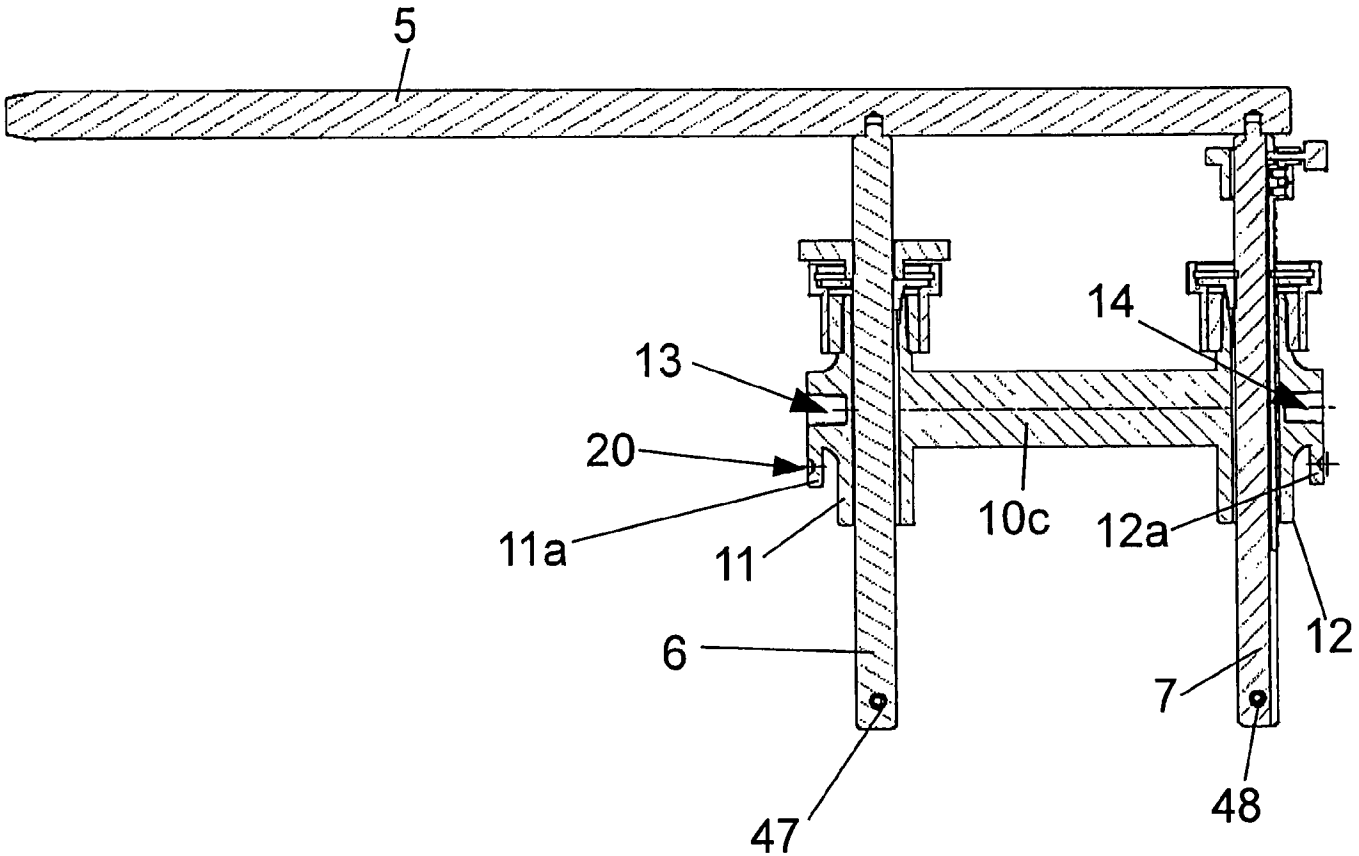
FIG. 4 shows a tool-support apparatus according to this embodiment of the invention which is attached to the grinding machine shown in the preceding figures.
Figure 10:
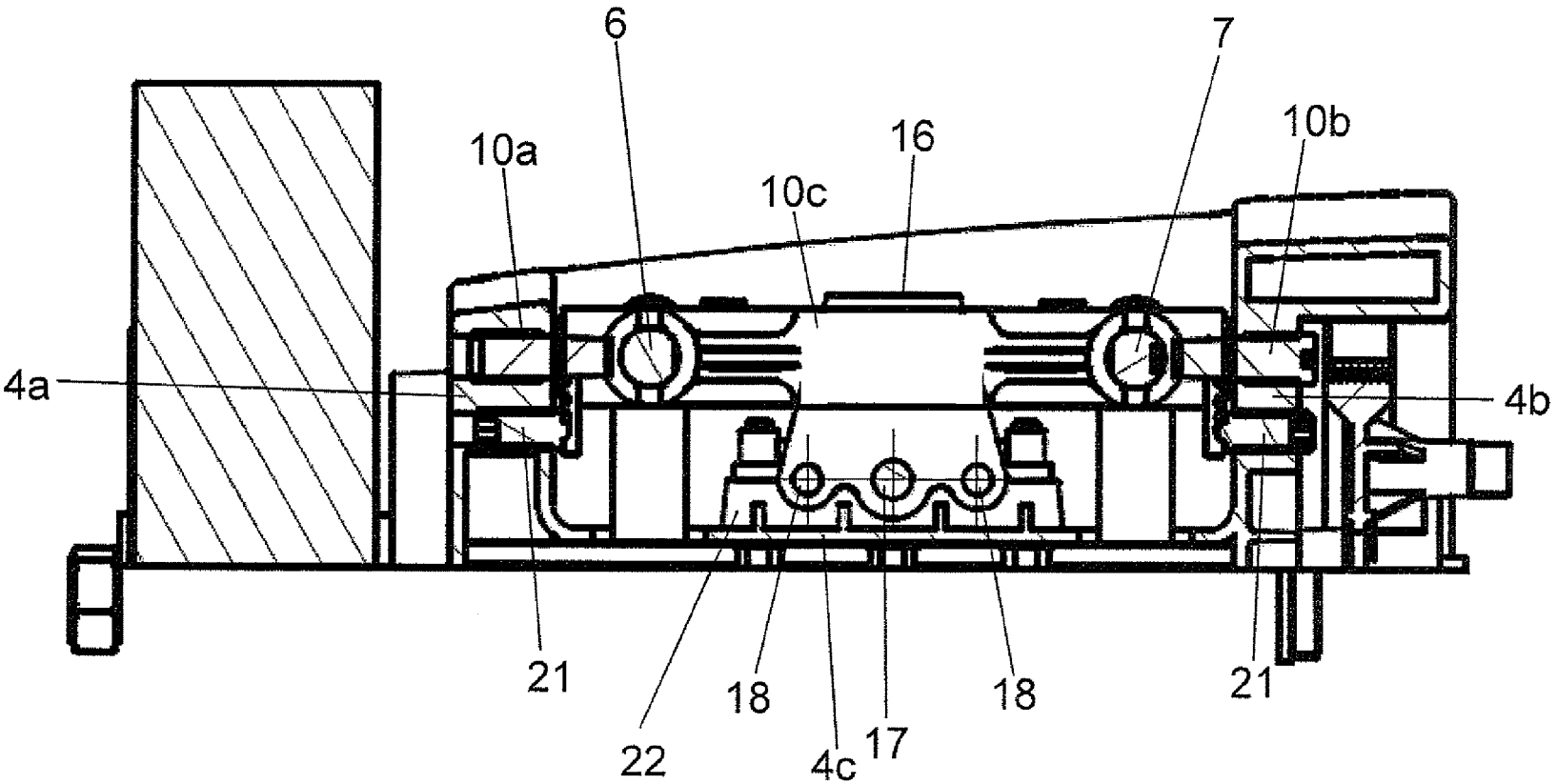
FIG. 10 shows a section along the line G-G in FIG. 3.

The swivel sleeves 11, 12 in this connection have, as can be identified in particular in FIG. 4, swivel-pin-receiving bores 13, 14 into which, as can be identified in particular in FIGS. 3 and 10, swivel pins 10*a*, 10*b* are plugged which in turn are screwed into threaded bores in alignment with the bores 13, 14, acting as receivers for the swivel pins, in two parallel housing walls 4*a*, 4*b* of the machine housing 4 between which the tool-support apparatus is received. The swivel pins 10*a*, 10*b* in this connection together with the cross-connecting hub 10*c* serve as a swivel axis 10, which is drawn in in FIG. 3.

Figure 5:
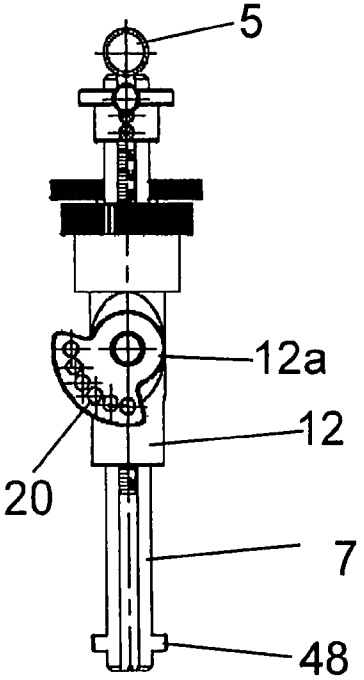
FIG. 5 shows an end view of the tool-support in FIG. 4.
Figure 7:
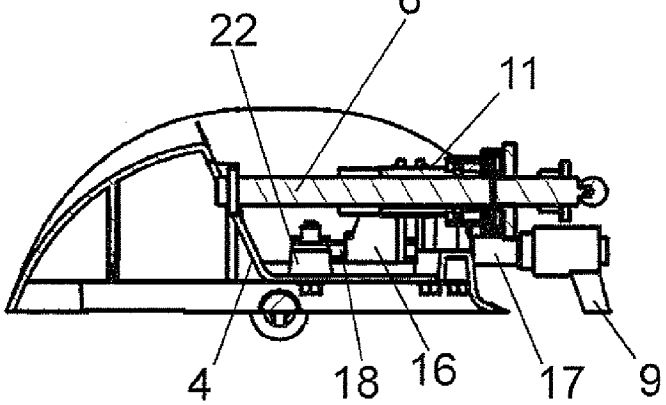
FIG. 7 shows a section along the line D-D in FIG. 2.
Figure 8:
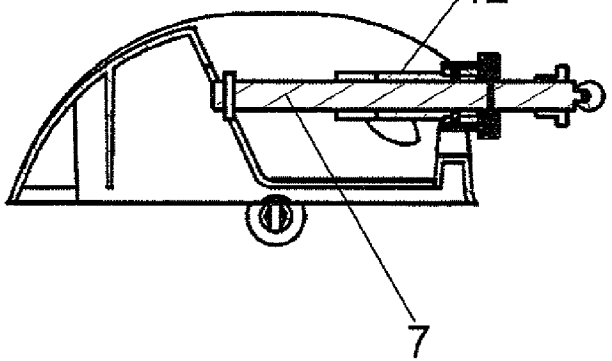
FIG. 8 shows a section along the line E-E of FIG. 2.

Provided on the two sides of the swivel sleeves 11, 12 facing outwards in the direction of the swivel axis there is in this connection, cf. FIGS. 4 and 5, a respective perpendicular wall section that serves as a locating-scale carrier 11*a*, 12*a* and arranged on which, arranged concentrically with respect to the swivel-pin receivers 13, 14, there is a row of locating receivers 20 with desired angular spacing from each other. Associated with the locating receivers 20 on the locating-scale carriers 11*a*, 12*a* there is then a respective locating bolt or pin 21, as can be inferred from FIG. 10, which is screwed into a threaded bore provided in the respective housing wall 4*a*, 4*b* with radial spacing of the locating receivers 20. In this way, a locating apparatus 20, 21 develops that gives a haptic signal when an established angular position is reached, for example all angles in the 15°-grid between the horizontal location of the longitudinal spars 6, 7, which are drawn in in the figures, and a perpendicular location of the longitudinal spars 6, 7.

The arresting apparatus can be inferred in particular from FIGS. 3 and 6. In this connection, a movable clamping jaw 16 acts on the outer circumferential contact section of the cross-connecting hub 10*c* when it is drawn by way of an arresting rod 17 in the direction of the cross-connecting hub 10*c* and comes out of contact with the cross-connecting hub 10*c* or the outer circumferential contact section when it is moved by way of the arresting rod 17 away from the cross-connecting hub 10*c* or the outer circumferential contact section. The movable clamping jaw 16 is in this connection guided on two guide pins 18, which can be inferred from FIGS. 6 and 10, in a horizontal direction that is perpendicular to the swivel axis 10.

Figure 9:
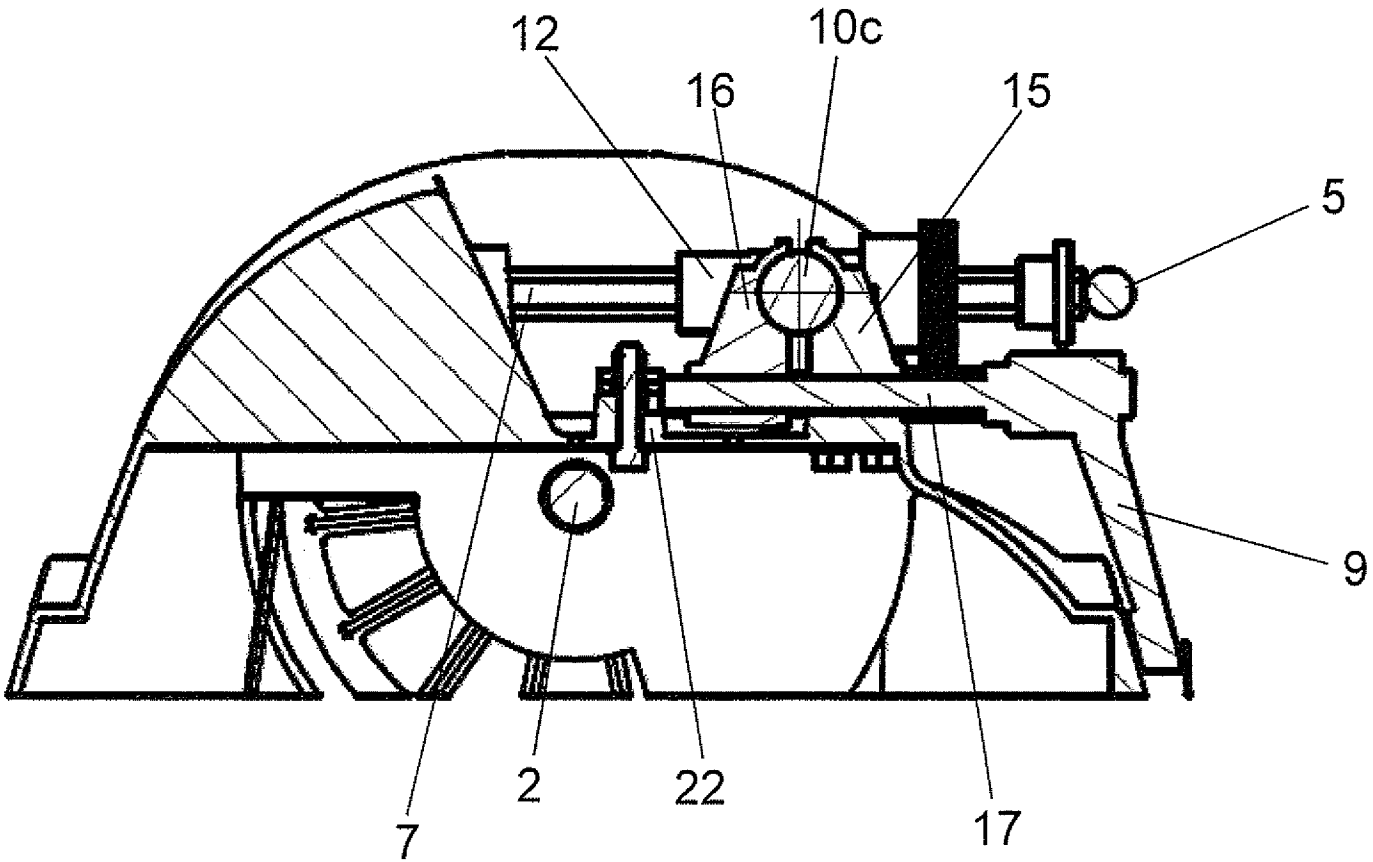
FIG. 9 shows a section along the line C-C in FIG. 2.

Arranged on the side of the cross-connecting hub 10*c* lying opposite the movable clamping jaw 16 there is in this connection a clamping jaw 15 which is fixedly screwed together with the machine housing 4 and against which the cross-connecting hub 10*c* or the outer circumferential contact section is pressed when the movable clamping jaw 16 is pressed by way of the arresting rod 17 against the cross-connecting hub 10*c*. The arresting rod 17 is in this connection guided through a bore in the fixed clamping jaw 15 with a trapezoidal threaded section and can be turned by way of a turning handle 9, which can be inferred in particular from FIG. 9, so that the clamping jaw 16, which is fixedly connected to the arresting rod 17, guided on the guide pins 18, can be brought into and out of contact with the cross-connecting hub 10*c*. The two guide pins 18 are in this connection screwed together with the machine housing 4 at one end by way of a securing bracket 22 and at the other end by way of the fixedly arranged clamping jaw 15.

Figure 11:
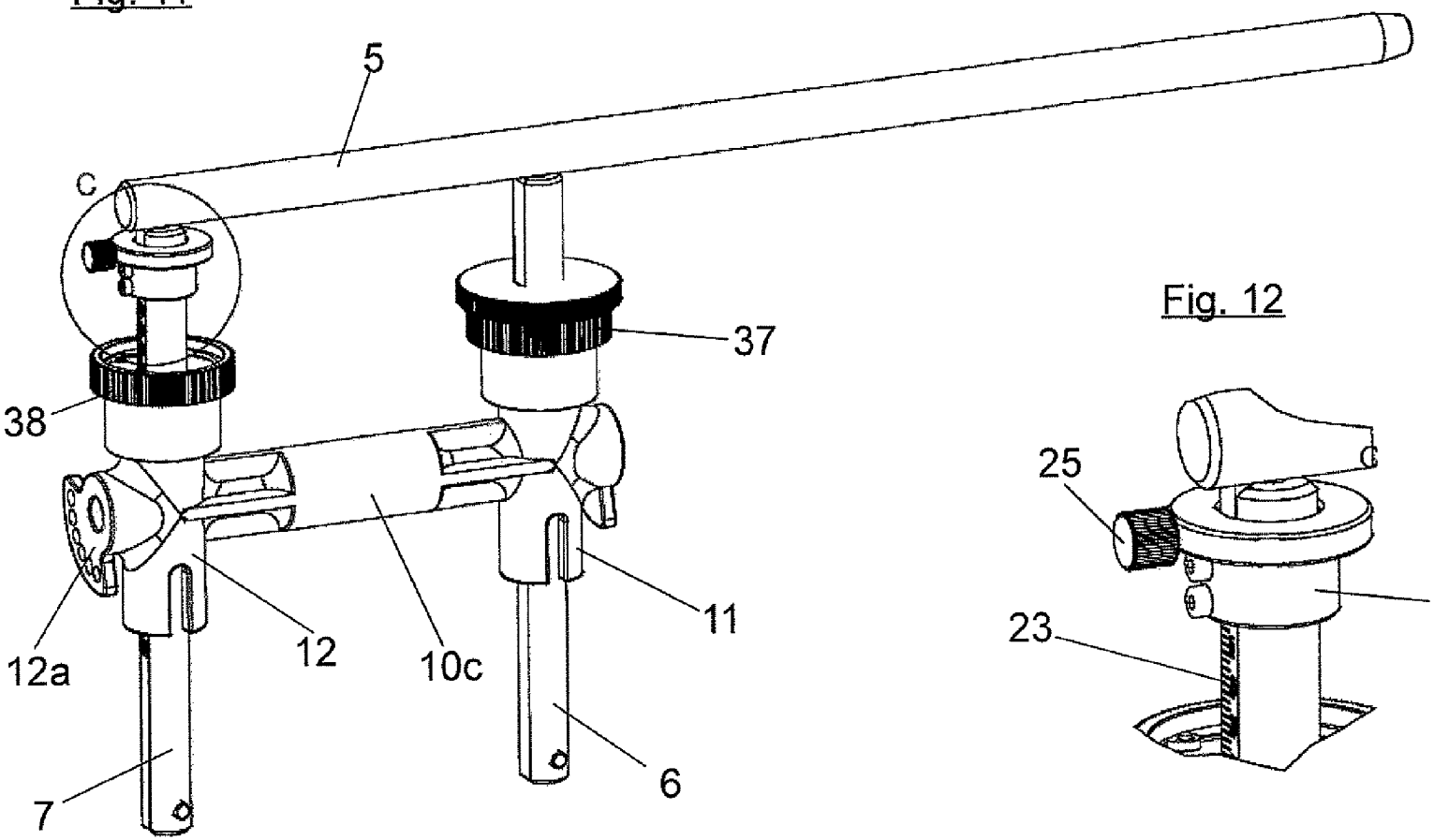
FIG. 11 shows a perspective view of the tool-support apparatus shown in FIGS. 4 and 5.
Figure 14:
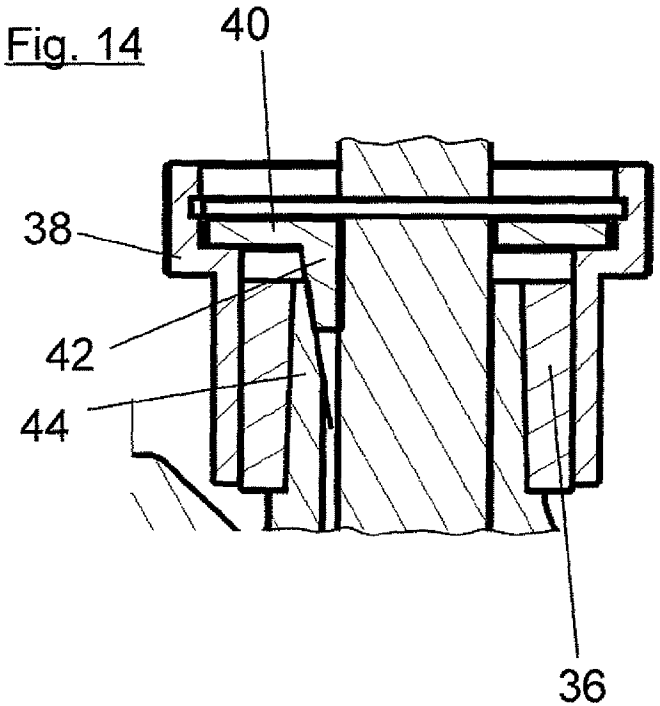
FIGS. 13 and 14 show individual views of swivel sleeves in which a tool-support of the tool-support apparatus shown in FIGS. 4, 5 and 11 is received in a vertically adjustable manner.
Figure 13:
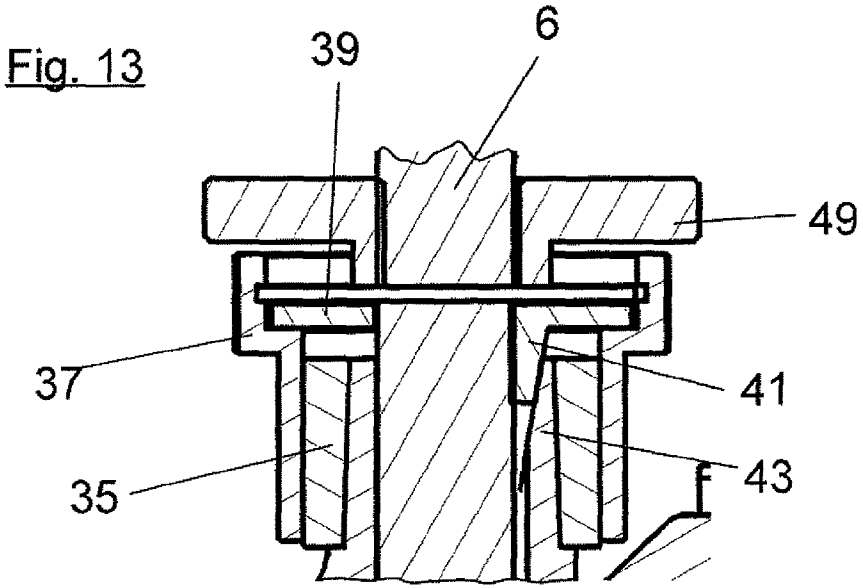
Figure 16:
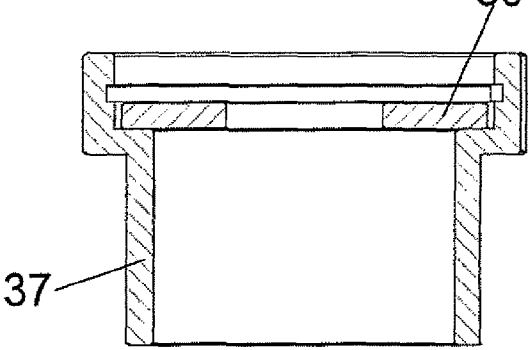
FIGS. 15 to 18 show individual views of a clamping bushing built in the swivel sleeves shown in detail in FIGS. 13 and 14.
Figure 18:
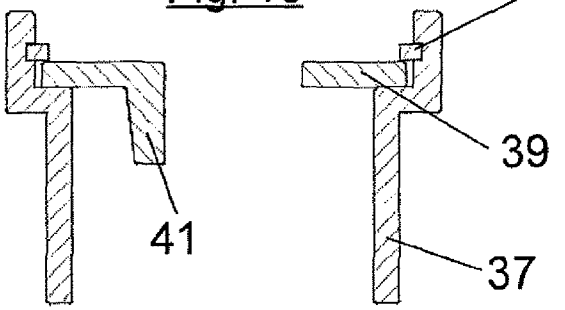
Figure 15:
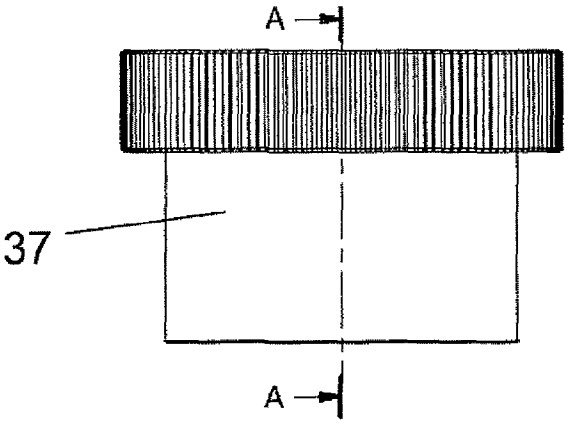
Figure 17:
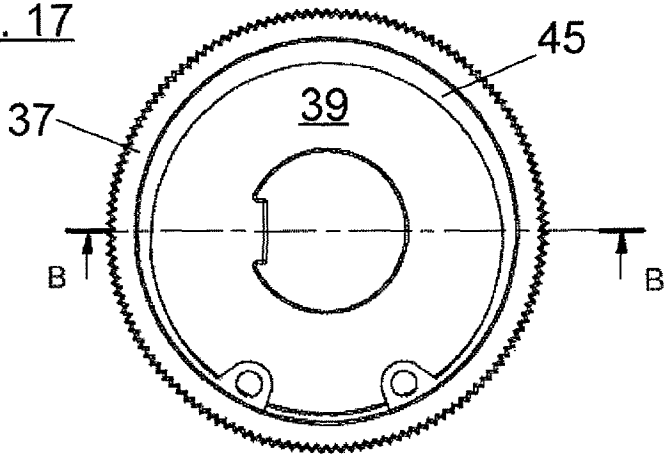

It can be inferred from FIGS. 13 and 14, when looked at together with FIG. 11, how the arrest of the vertical adjustment of the longitudinal spars 6, 7 in the swivel sleeves 11, 12 functions.

The swivel sleeves 11, 12 have an inside diameter which is greater than the diameter of the longitudinal spars 6, 7. For the purposes of arrest and release of the longitudinal spars 6, 7 in the swivel sleeves 11, 12, in this connection clamping bushings 37, 38 are screwed onto threaded sleeves 35, 36 that are set onto the free ends of the swivel sleeves 11, 12. Held in the clamping bushings 37, 38, expanding on the upper side, by way of an associated securing ring 45, 46 there is in this connection in each case a clamping disc 39, 40. FIGS. 15 to 18 show the clamping bushing 37 with clamping disc 39 and securing ring 45. The clamping bushing 38, clamping disc 39 (sic) and securing ring 46 are identical in terms of construction.

The clamping discs 39, 40 in this connection in each case have a wedge section 41, 42 which tapers downwards and rests against the outer circumference of the respective longitudinal spar 6, 7 on the inner-circumferential side. On the outer-circumferential side the wedge section 41, 42 rests with its wedge-shaped surface against a corresponding inwardly facing surface of a wedge section 43, 44 provided at the upper free end of the respective swivel sleeve 11, 12 and tapering upwards. If the clamping bushing 37 or 38 is now screwed onto the threaded bushing 35 or 36 respectively, the clamping disc 39 or 40 respectively with its wedge section 41 or 42 respectively is caused to become connected in a clamped manner with the counter-wedge section 43 or 44 respectively, whereby the respective longitudinal spar 6 or 7 respectively is arrested at its set height. By loosening the clamping bushing 37 or 38 respectively the height of the longitudinal spar 6 or 7 respectively can then be set anew.

There is additionally provided on the longitudinal spar 6 a fine thread on which a knurled nut 49 acts, as indicated in FIG. 13. This knurled nut 49 is used for the fine adjustment of the vertical location of the tool-support.

Figure 12:
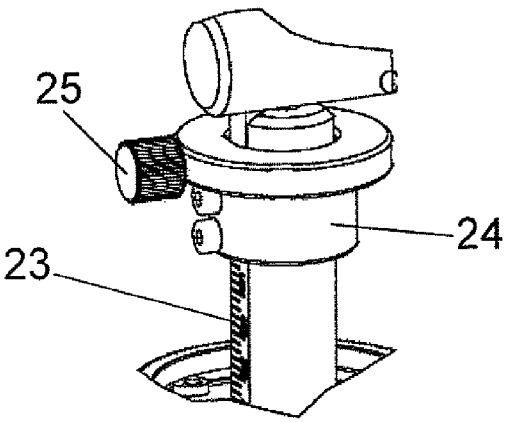
FIG. 12 shows detail C in FIG. 11.

FIG. 12 further shows, when looked at together with FIG. 11, a device with which the height of extraction of the longitudinal spars 6, 7 out of the swivel sleeves 11, 12 can be rapidly set to the diameter of the grinding disc 3.

For this, a disc 24 specifying a zero point is slid onto the longitudinal spar 7 between the transverse spar 5 and the swivel sleeve 12 and can be secured on the longitudinal spar 7 by way of a fastening screw 25 provided with a knurled grip. Furthermore, provided along the longitudinal spar 7 there is a length scale 23 which can be displaced preferably with the securing disc 24.

If the scale 23 is to be "zeroed" with respect to the diameter of the grinding disc 3, the transverse spar 5 is laid onto the grinding disc 3 and the zero-point disc 24 is fastened, supported on the clamping disc 39, by way of the fastening screw 25. When the tool-support 5, 6, 7 is next pulled out of the swivel sleeves 11, 12, the height of extraction can be read off directly, starting from the grinding-disc diameter specified by the zero-point disc 24.

Modifications and variations of the embodiment shown are possible without departing from the scope of the invention.

LIST OF REFERENCE NUMERALS

Grinding machine (1)
Grinding-disc shaft (2)
Grinding disc (3)
Machine frame or housing (4)
Housing walls (4*a*, 4*b*)
Base section (4*c*)
Support-section or transverse spar (5)
Longitudinal spars (6, 7)
Tool-support (5, 6, 7)
Arresting apparatus (8)
Clamping-jaw-actuating device (9, 17)
Grip (9)
Swivel axis (10)
Swivel pins (10*a*, 10*b*)
Cross-connecting hub (10*c*)
Swivel piece (11, 12, 10*c*)
Swivel sleeves (11, 12)
Locating-scale carrier (11*a*, 12*a*)
Swivel-pin-receiving bores (13, 14)
Clamping jaw, fixed (15)
Clamping jaw, movable (16)
Arresting rod (17)
Guiding device (18, 22)
Guide pins (18)
Locating receivers (20)
Locating pins (21)
Securing bracket (22)
Length scale (23)
Zero-point disc (24)
Fastening screw (25)
Threaded sleeves (35, 36)
Clamping bushings (37, 38)
Clamping discs (39, 40)
Wedge sections (41, 42)
Counter-wedge sections (43, 44)
Securing discs (45, 46)
Securing pins (47, 48)
Knurled nut (49)

The invention claimed is:

1. A tool-support apparatus for attachment to a grinding machine (1), in particular to a wet grinding machine, which has at least one grinding disc (3) arranged on a rotatably drivable grinding-disc shaft (2) and a machine frame or housing (4) in which the grinding-disc shaft (2) is supported, having:

a tool-support (5, 6, 7), which can be secured on the machine frame or housing (4) of the grinding machine (1), for the support during the grinding process of a tool that is to be ground, and an arresting apparatus (8) for securing the tool support (5, 6, 7) on the machine frame or housing (4), wherein the tool-support (5, 6, 7) can be secured on the machine frame or housing (4) in such a way that the tool support can be swivelled about the grinding-disc shaft (2) or about a swivel axis (10) parallel to the grinding-disc shaft (2) and can be arrested by way of the arresting apparatus (8) in a plurality of angular positions; and longitudinal spars (6, 7) are received in associated swivel sleeves (11, 12), which in turn are received on one or two swivel pins (10*a*, 10*b*) serving as the swivel axis (10).

2. A tool-support apparatus according to claim 1, wherein:

the tool support (5, 6, 7) has a support section (5), which in the attached state overlaps the grinding disc (3) on the circumferential side and extends axially parallel to the grinding-disc shaft (2), for the support during the grinding process of a tool that is to be ground, and a spacer section, which holds the support section (5) spaced apart from the outer circumference of the grinding disc (3); and the support section (5) has in particular the form of a transverse spar (5) and the spacer section two longitudinal spars (6, 7) secured on the transverse spar spaced apart from each other.

3. A tool-support apparatus according to claim 1 wherein:

the longitudinal spars (6, 7) are received in a vertically adjustable manner in the associated swivel sleeves (11, 12).

4. A tool-support apparatus according to claim 1, wherein:

a swivel piece (11, 12, 10*c*) is provided that can be received on the machine housing (4) in such a way that it can be swivelled and by way of which the tool-support (5, 6, 7) can be secured on the machine housing (4), wherein the swivel piece (11, 12, 10*c*) has a preferably cylindrical or at least cylinder-segment-shaped outer circumferential contact section extending coaxially or parallel to the swivel axis (10) in the state of securement on the machine housing (4); and the arresting apparatus (8) has at least one clamping jaw (16), movable in and out of contact with the outer circumferential contact section and having an inner circumferential contact section which is preferably substantially semi-cylindrical, and also a clamping-jaw-actuating device (9, 17) in order to move the movable clamping jaw (16) in and out of contact with the outer circumferential contact section so that the swivel piece (11, 12, 10*c*) can be arrested in its angular location with respect to the machine housing (4) and can be released for swivelling.

5. A tool-support apparatus according to claim 4, wherein:

the swivel piece (11, 12, 10*c*) is formed by means of the two swivel sleeves (11, 12) which are connected by way of a cross-connecting hub (10*c*) and the outer circumferential contact section for the movable clamping jaw (16) is preferably formed on the cross-connecting hub (10*c*).

6. A tool-support apparatus according to claim 4, wherein:

the swivel piece (11, 12, 10*c*) has on both sides a respective receiving bore (13, 14), which is coaxial with respect to the swivel axis (10), for a respective swivel pin (10*a*, 10*b*) in order to suspend the swivel piece (11, 12, 10*c*) in such a way that the swivel piece can be swivelled between two housing walls (4*a*, 4*b*) of the machine housing (4) so that the swivel pins (10*a*, 10*b*) serve as the swivel axis (10).

7. A tool-support apparatus according to claim 4, wherein:

a guiding device (18, 22) for the movable clamping jaw (16) is provided by way of which the movable clamping jaw (16), displaceably guided in a direction of displacement that is inclined with respect to the axial direction of the swivel axis (10), preferably extends perpendicularly, and is preferably horizontal, can be fitted on the machine housing (4) so that the movable clamping jaw (16) can be displaced in the radial direction of the swivel axis (10) or with a radial-direction component towards and away from the outer circumferential contact section.

8. A tool-support apparatus according to claim 7, wherein:

the guiding device (18, 22) has at least two guide pins (18) that can be fitted on the machine housing (4) in parallel and at a distance from each other extending in the direction of displacement and on which the movable clamping jaw (16) is received in a displaceable manner and the guiding device (18, 22) preferably has a securing bracket (22) that can be screwed together with or secured in another way on the machine housing (4) and on which the guide pins (18) are secured.

9. A tool-support apparatus according to claim 4, wherein:

the clamping-jaw-actuating device (9, 17) has, for moving the movable clamping jaw (16) into and out of contact with the outer circumferential contact section, an arresting rod (17) which is connected to the movable clamping jaw (16) and on which a handle (9) is secured.

10. A tool-support apparatus according to claim 9, wherein:

the arresting rod (17) has a thread, in particular a trapezoidal thread, with which the screwing rod is screwed in a securing block (15), which can be fitted in a fixed manner with respect to the housing and is preferably formed in one piece with the securing bracket (22), with a screw axis extending in the direction of displacement wherein the arresting rod (17) is connected to the movable clamping jaw (16) in a rotatable, yet pressure- and tensile-force-transmitting manner.

11. A tool-support apparatus according to claim 4, wherein:

provided on the side of the outer circumferential contact section lying opposite the movable clamping jaw (16) there is a second clamping jaw (15) which is fixed with respect to the housing, is preferably formed in one piece with the securing block (15) that can be fitted in a fixed manner with respect to the housing, and preferably has a substantially semi-cylindrical inner circumferential contact section.

12. A tool-support apparatus according to claim 3, wherein:

the swivel sleeves (11, 12) each have in the proximity of their upper free end an outer circumferential threaded section (35, 36) on which there is screwed a clamping bushing (37, 38) provided with an inner circumferential thread; and provided on the clamping bushings (37, 38) there is in each case a clamping-ring section (39, 40) with a wedge section (41, 42) which tapers in its course from top to bottom inwards and with which a counter-wedge section (43, 44) tapering in its course from bottom to top outwards is associated at the upper free end of the respective swivel sleeve (11, 12) so that the clamping bushings (37, 38), received on the swivel sleeves (11, 12), hold the longitudinal spars (6, 7) by screwing on far enough or release them by unscrewing far enough for the vertically adjusted position.

13. A tool-support apparatus according to claim 3, wherein:

at least one (7) of the longitudinal spars (6, 7) is provided with a scale (23) indicating the height of extraction of the tool-support (5, 6, 7), wherein the scale (23) preferably displaceable along the longitudinal spar (7) is secured at a stop disc (24) that is positioned about the longitudinal spar (7) and can be fixed at a desired height.

14. A grinding machine (1), in particular a wet grinding machine (1), having at least one grinding disc (3) arranged on a rotatably drivable grinding-disc shaft (2), a machine frame or housing (4) in which the grinding-disc shaft (2) is supported, and a tool-support (5, 6, 7), which is secured on the machine frame or housing (4), for the support during the grinding process of a tool that is to be ground, wherein:

the tool support (5, 6, 7) is secured on the machine frame or housing (4) in such a way that the tool support can be swivelled about the grinding-disc shaft (2) or about a swivel axis (10) parallel to the grinding-disc shaft (2) and can be arrested by way of an arresting apparatus (8) in a plurality of angular positions,;

provided on the upper side of the machine housing (4) there are two parallel housing walls (4*a*, 4*b*) between which a swivel piece (11, 12, 10*c*) is received the housing walls (4*a*,4*b*) have through-threaded bores into which the swivel pins (10*a*,10*b*) are screwed from the wall side that is remote from the swivel piece (11, 12, 10*c*); and the housing walls (4*a*, 4*b*) laterally delimit a trough on the upper side in the machine housing (4) which has a base section (4*c*) on which the securing bracket (22) and/or the securing block are set and screwed.

15. A grinding machine (1) according to claim 14, wherein:

the grinding-disc shaft (2) can be driven selectively in both directions of rotation.

* * * * *